US007296662B1

(12) United States Patent
Fargo

(10) Patent No.: US 7,296,662 B1
(45) Date of Patent: Nov. 20, 2007

(54) ELEVATOR SYSTEM WITH ESCALATOR-LIKE PASSENGER FLOW

(75) Inventor: Richard N. Fargo, Plainville, CT (US)

(73) Assignee: Otis Elevator Company, Farmington, CT (US)

( * ) Notice: Subject to any disclaimer, the term of this patent is extended or adjusted under 35 U.S.C. 154(b) by 592 days.

(21) Appl. No.: 09/571,827

(22) Filed: May 16, 2000

(51) Int. Cl.
*B66B 11/04* (2006.01)

(52) U.S. Cl. ..... 187/382; 187/251; 187/257; 187/258; 187/383

(58) Field of Classification Search ..... 187/249, 187/250–254, 256–258, 266, 315, 316, 382, 187/383, 385–387, 389, 394, 396, 414, 901
See application file for complete search history.

(56) References Cited

U.S. PATENT DOCUMENTS 1,943,119 A * 1/1934 James ..... 198/794
5,584,364 A 12/1996 Sakita ..... 187/249

FOREIGN PATENT DOCUMENTS

JP 1-247385 A * 10/1989 ..... 187/414
JP 10-246020 9/1998
JP 10-246020 A * 9/1998
JP 11-335037 12/1999

OTHER PUBLICATIONS

George R. Strakosch, "The Vertical Transportation Handbook" 3rd, pp. 58-61, published in 1998 by John Wiley & Sons, Inc.*

* cited by examiner

*Primary Examiner*—Eileen D. Lillis
*Assistant Examiner*—M. Buiz
(74) *Attorney, Agent, or Firm*—Carlson, Gaskey, & Olds

(57) ABSTRACT

A passenger flow arrangement for use in moving passengers between two floors in elevator-like cabs allow the passenger to continue to face in a forward direction and exit the vehicle after having entered in the forward direction. In one aspect of this invention, a cab door on one side of the cab opens at a first of the floors, and a door on an opposed side of the cab opens at a second of the floors. In other arrangements, there are cab doors at each side of the cab, and one of the cab doors opens as an entrance door while the other opens as an exit door. Appropriate signals such as signs or door opening timing prompt the passengers to face and move in the appropriate directions.

8 Claims, 2 Drawing Sheets

ELEVATOR SYSTEM WITH ESCALATOR-LIKE PASSENGER FLOW

BACKGROUND OF THE INVENTION

This invention relates to a passenger flow method for an elevator system that decreases the time the passengers need to enter and exit the elevator.

Typically, passengers are moved between the floors in low rise buildings such as malls, etc. by escalators. Escalators are widely utilized in malls since they tend to move more passengers more quickly between a few floors. Most malls incorporate a few elevators for moving passengers between the floors; however, such elevators do not move as many passengers as quickly as the escalators due to the door opening times, wait times, etc. Moreover, shoppers in a mall seem to prefer escalators in that they move more quickly between the floors, and perhaps because the shoppers have the ability to look around the mall while traveling on the escalator.

Statistics show that an average escalator moves a much higher number of passengers than an average elevator in such locations. However, escalators have down sides. As an example, escalators do not transport strollers, wheelchairs, etc. as easily as elevators.

Recently, the assignee of the present application developed a piston-type passenger conveying system that functions much like an elevator. One embodiment has at least three cabs utilized to move between two floors. One cab is waiting at each floor at all times. Another cab is generally moving between the floors. This piston system provides the main benefits of both an escalator and an elevator. The basic movement technology is elevator technology. However, passenger flow is continuous, and thus a higher number of passengers can theoretically move between the floors. The basic invention as described above is disclosed in U.S. patent application Ser. No. 09/571,769, entitled "Piston-Type Passenger Conveying System," filed on even date herewith.

With such a system, the time required for moving the passengers is limited by the time it takes the passengers to enter and leave the cab. One factor that results in lag time from passenger movement into and out of an elevator cab is that the passengers typically must turn within the cab. While this may not be too time consuming for most passengers, passengers in wheelchairs, or passengers with strollers do require significant time and space to turn. Thus, the passenger flow time through the elevator cab could be undesirably high in such systems.

A system to improve the flow of passengers through the cab would be desirable.

SUMMARY OF THE INVENTION

In a disclosed embodiment of this invention, a method is described wherein passengers enter an elevator cab at one side, and exit through the other. In this way, there is no need for a passenger to turn within the cab. Passengers with strollers, wheelchairs, etc. do not need to turn within the cab. Thus, the time required for the passenger to enter and then leave the cab is significantly reduced compared to the prior art. This aspect of the invention becomes particularly important in the piston system such as described above wherein there is continuous movement of the cabs. This is particularly valuable in a system moving passengers between two floors.

One benefit of this arrangement is that a elevator cab can be thinner. There are regulations as to the required width of an elevator cab, and which relate to the ability of a wheelchair to turn within the cab. However, since the present invention does not require a wheelchair to turn, these regulations may not be applicable.

In a disclosed embodiment, the piston system is arranged such that a door is placed on one side of the cab at one floor, and the door is on the opposed side of the cab at the second floor. A sign within the cab may direct the passenger to face in the proper direction. Thus, a passenger need only step into the cab, and continue facing in the same direction. At the next floor, the cab door would open and the passenger can then exit in that direction.

In a second embodiment of this invention, the cab does have doors at each side that open at both floors. Signs direct the passenger to face in the appropriate direction.

Moreover, such a system can further assist the passengers in moving in the right direction by having the exit doors open a short period of time before the entrance doors. In such a system, passengers would enter at one side and leave at the opposed side. Again, this increases the flow of passengers through the system. Also, the passengers wishing to enter do not need to wait for the exiting passengers. Again, the necessary time to load and off load passengers is reduced.

These and other aspects of the present invention can be best understood from the following specification and drawings, the following of which is a brief description.

DETAILED DESCRIPTION OF A PREFERRED EMBODIMENT

Figure 1:
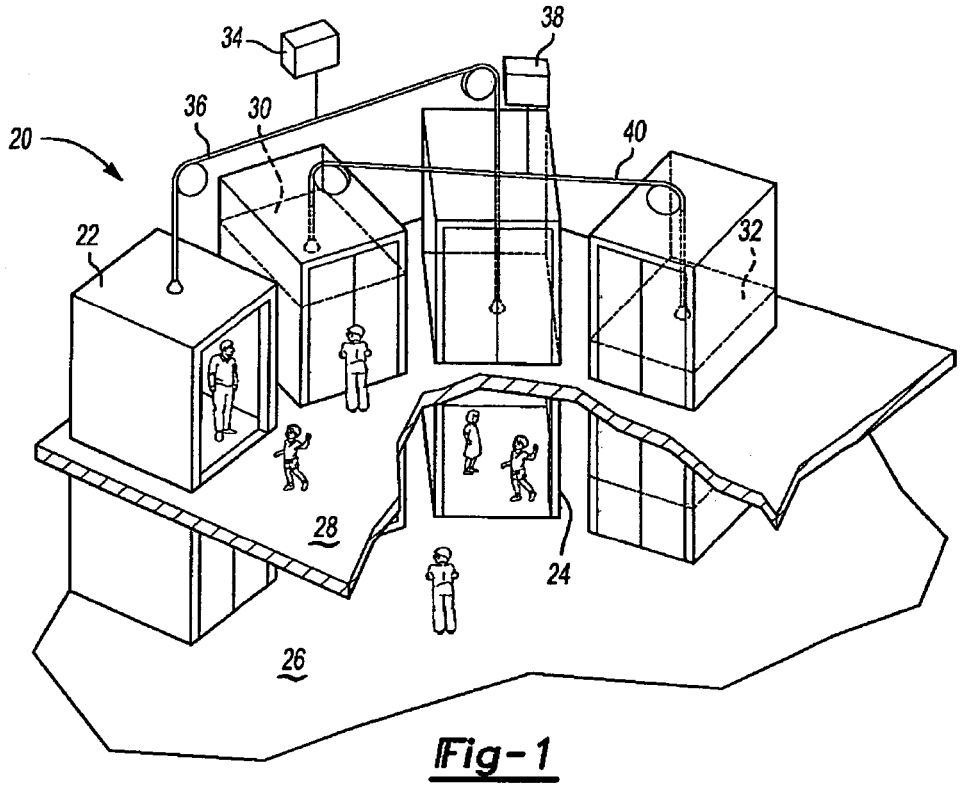
FIG. 1 is a schematic view of a piston-type passenger conveying system.

FIG. 1 shows a piston-type passenger conveying system 20. This system is generally as disclosed in the U.S. patent application Ser. No. 09/571,769, disclosed above. In system 20, one cab (cab 22 and cab 24) will always be at respective floors 26 and 28. A third and a fourth cab, here cabs 30 and 32, are moving to each floor. The elevators are all maintained 90° out of phase from each other, and are thus continuously moving between the two floors. In at least one embodiment in the above-referenced application, there are only three cabs. The cabs are maintained 120 degrees out of phase.

For the purposes of this application, the term "out of phase" refers to a cycle of movement of the cabs between the floors. As an example, a cycle of movement can be defined from the time a cab first arrives at one floor until the time it next reaches that floor. The cabs are out of phase within that cycle of movement relative to their respective positions.

Further, for purposes of this application, the description of a cab being at each floor with a cab moving to a floor should be taken as being reflective of the general, or usual movement and position. It may well be that a cab may arrive at a particular floor a short period of time before the cab at that floor leaves, or visa versa. Moreover, within the control for the cabs, it is possible for the general cycle of movement to be overridden for certain periods of time. As an example, when a mall first opens, it may be desirable to have all of the cabs originally at the ground floor. However, in general, the above description of the movement of the several cabs provides a good understanding of the basic cycle of operation.

In this way, the flow of passengers through the systems is increased, and is closer to the flow on an escalator.

A machine 34 for driving a cable 36 connects the cabs 22 and 24. A similar machine 38 driving a rope cable connects the cabs 30 and 32. It should be understood that the basic elements of this system are schematically disclosed, and the above-referenced United States patent application should be reviewed to determine the specific details of such a system.

Figure 2:
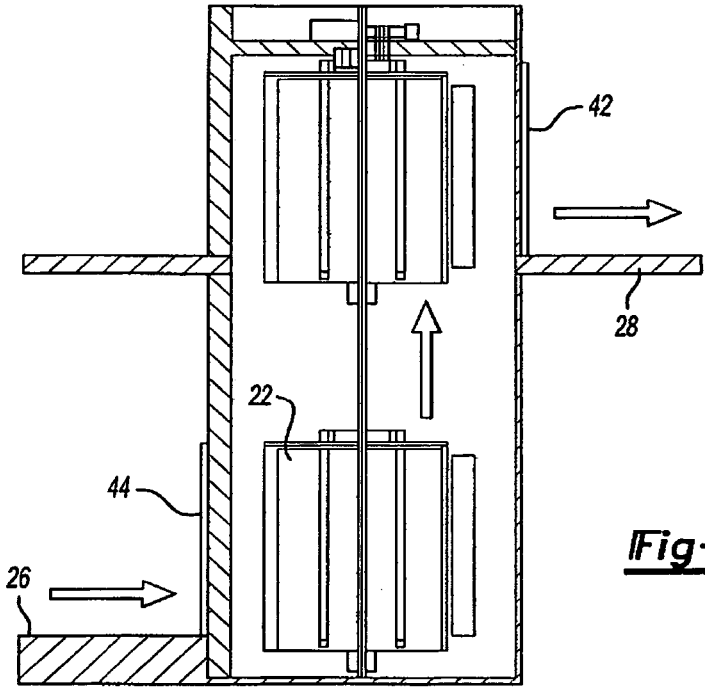
FIG. 2 shows a first embodiment of this invention.

FIG. 2 shows a basic arrangement of the doors for a system such as shown in FIG. 1 which increases passenger flow. A door 42 is positioned on one side of the cab 22 at the floor 28, and a door 44 is on the opposed side at the floor 26. In this way, a passenger entering the cab 22 can continue to face in the same direction and can exit the cab at the floor 28. This speeds the movement of the passengers through the cab 22, as it eliminates the time necessary for the passengers to turn within the cab. As mentioned above, this time may not be significant for most mobile passengers; however, passengers with strollers, wheelchairs, etc. do require significant time.

Figure 3A:
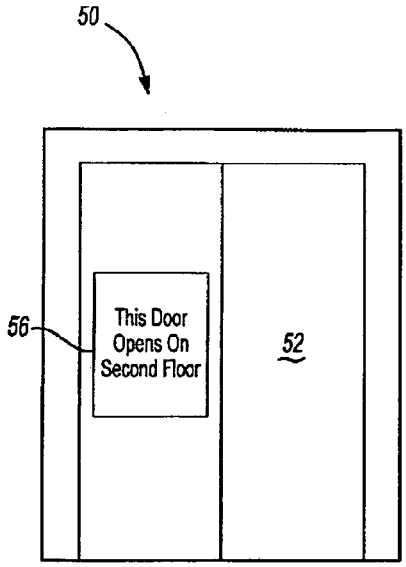
FIG. 3A shows a feature of a second embodiment.
Figure 3B:
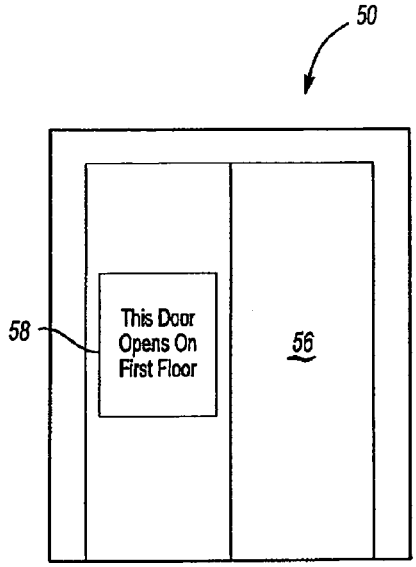
FIG. 3B shows another feature similar to the FIG. 3A feature.

Another embodiment 50 is illustrated in FIGS. 3A–3B. In embodiment 50, doors open on both sides of the cab 22. Door 52 is the exit door on the second floor. As shown in FIG. 3A, a sign 54 indicates to passengers that the door 52 opens on the second floor. As shown in FIG. 3B, a door 56 has a sign 58 indicating that it opens on the first floor. In this way, a passenger entering on the first floor will be instructed to continue to face forwardly and that the door 52 will be the one that opens on the second floor. Similarly, a passenger will be instructed that he should continue to face the door 56 when moving toward the first floor.

Figure 3C:
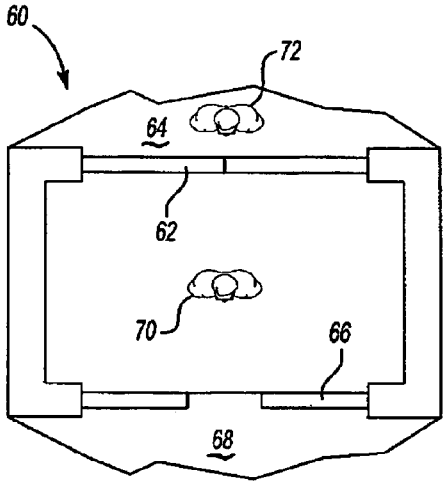
FIG. 3C schematically shows another aspect of a third embodiment of this invention.
Figure 3D:
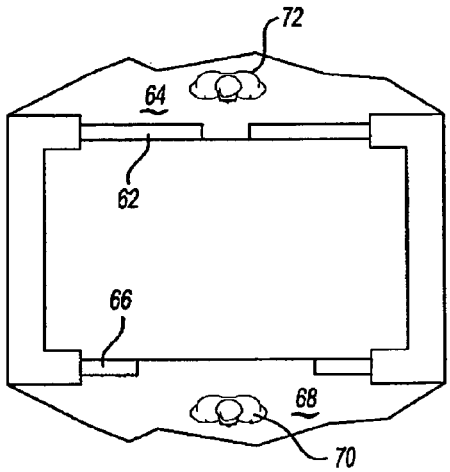
FIG. 3D shows a view similar to FIG. 3C.

FIG. 3C shows an improved system 60 for further increasing passenger flow, and making the elevator system even more like an escalator for passenger flow. As shown, a door 62 is positioned adjacent a loading area 64. A door 66 is positioned adjacent an exit area 68. An exiting passenger 70 is allowed to exit by the door 66 which opens shortly before the doors 62. As shown in FIG. 3D, the door 62 will begin opening soon after the beginning of door 66 in a most preferred embodiment. The passenger 72 will then know to load into the cab 60, and will be facing in the proper direction. As shown, passenger loading areas 100 and exiting areas 102 are defined at the two sides of the cabs in this embodiment. Such a loading zone/exit zone is defined on both floors in this embodiment.

With the FIGS. 3A–D embodiments, each door is the entrance door on one floor, but the exit door on the other floor.

Preferred embodiments of this invention have been disclosed; however, a worker of ordinary skill in the art would recognize that certain modifications would come within the scope of this invention.

The invention claimed is:

1. A passenger conveying system comprising:

a plurality of cabs movable between two floors, each of said cabs having a first door for entering and a second door for exiting;

said cabs being arranged such that a passenger enters one of said cabs through said first door in a forward direction at one of said two floors, and then exits said one of said cabs through said second door moving in said forward direction at the second of said two floors; and said system having at least three cabs, with a control attempting to keep one cab waiting at each of said two floors with a third cab moving between said two floors.

2. A system as set forth in claim 1, wherein there are four of said cabs and said four cabs are paired in groups of two, with a single motor driving each of said pairs.

3. A passenger conveying system comprising:

a plurality of cabs movable between two floors, each of said cabs having a first door for entering and a second door for exiting;

said cabs being arranged such that a passenger enters one of said cabs through said first door in a forward direction at one of said two floors, and then exits said one of said cabs through said second door moving in said forward direction at the second of said two floors;

a control for controlling said first and second door such that said first door opens on said floors as said door for entering;

said second door opens on said floors as said door for exiting; and said doors being provided on opposed sides of said cab, and said second door opening a short period of time before said first door begins to open.

4. A system as set forth in claim 3, wherein a passenger loading zone is defined adjacent said first door, and a passenger exit zone is defined adjacent said second door at each of said first and second floors.

5. A system as set forth in claim 3, wherein said system having at least three cabs, with a control attempting to keep one cab waiting at each of said two floors.

6. A passenger conveying system comprising:

at least four cabs, said cabs being joined into two pairs each containing two cabs, each of said pairs having a motor for driving said cabs between two floors;

a control for said four cabs that attempts to move said cabs such that one of said four cabs is waiting at each of said floors and another of said four cabs is moving to each of said floors most times; and each of said cabs being provided with a door arrangement such that a passenger may enter said cab facing in a forward direction on one of said floors, and continue to face in said forward direction and move in said forward direction to exit said cab at another of said floors.

7. A system as recited in claim 6, wherein a door on one side of said cab opens on a first of said floors, and a door on an opposed side of said cab opens on a second of said floors.

8. A system as set forth in claim 7, wherein doors are provided on each side of said cabs, with one of said doors being an entrance door and one of said doors being an exit door.

* * * * *